US006009738A

United States Patent [19]

Beecher et al.

[11] Patent Number: 6,009,738

[45] Date of Patent: Jan. 4, 2000

[54] APPARATUS FOR FORMING METAL

[76] Inventors: Roy Beecher; Maureen Beecher, both of 88 Low Road, Dewsbury, United Kingdom, WF12 OPU

[21] Appl. No.: 09/068,808

[22] PCT Filed: Nov. 18, 1996

[86] PCT No.: PCT/GB96/02817

§ 371 Date: May 15, 1998

§ 102(e) Date: May 15, 1998

[87] PCT Pub. No.: WO97/18908

PCT Pub. Date: May 29, 1997

[30] Foreign Application Priority Data

Nov. 17, 1995 [GB] United Kingdom ..... 9523515

[51] Int. Cl.[7] ..... B21D 11/14

[52] U.S. Cl. ..... 72/299

[58] Field of Search ..... 72/299, 298, 371, 72/64, 65

[56] References Cited

U.S. PATENT DOCUMENTS

| | | | |
|---|---|---|---|
| 111,097 | 1/1871 | Tuddenham | 72/371 |
| 1,013,769 | 1/1912 | Haskell | 72/299 |
| 2,145,040 | 1/1939 | Cawthra | 72/299 |
| 2,628,653 | 2/1953 | Sherman | 72/371 |
| 4,019,356 | 4/1977 | Bohl | 72/371 |
| 4,026,137 | 5/1977 | Scroggins | 72/299 |
| 5,676,013 | 10/1997 | Kahlau | 72/299 |

FOREIGN PATENT DOCUMENTS

| | | | |
|---|---|---|---|
| 2358213 | 2/1978 | France . | |
| 2378123 | 8/1978 | France . | |
| 2233079 | 1/1974 | Germany | 72/299 |
| 196121 | 11/1983 | Japan | 72/299 |
| 6198350 | 7/1994 | Japan . | |

*Primary Examiner*—Daniel C. Crane
*Attorney, Agent, or Firm*—Zarley, McKee, Thomte, Voorhees & Sease

[57] ABSTRACT

The apparatus allows a metal blank which, in one embodiment, comprises a plurality of bars held in parallel relationship, to be formed into a twisted and bowed shaped object (4) which is referred to in the art as a basket. The forming can be achieved without the need for heating of the metal blank or high powered drive means and so, in one embodiment, can be formed by cold forming and the apparatus can be manually driven. The apparatus can also be adapted to form metal blanks into other forms by the fitting of appropriate forming tools.

19 Claims, 15 Drawing Sheets

APPARATUS FOR FORMING METAL

This application is a 371 of PCT/GB96/02817, filed Nov. 18, 1996.

BACKGROUND OF THE INVENTION

The invention which is the subject of this application relates to apparatus for use in forming metal into shapes or articles by rotation of an element of the apparatus. Particularly, but not exclusively, the apparatus is for use in forming metal bars which are joined together at their ends, into a twisted and enlarged shape which is referred to from hereonin as a basket shape and is illustrated in the accompanying drawings.

At present, there is apparatus available which can perform the required functions of twisting and applying a compression force to metal bars to form the same into a basket shaped article. However, this apparatus is usually relatively complex and relies upon the provision of a hydraulic system to enable the forces which are required to be applied to be provided. The requirement for the hydraulic systems to be provided render the apparatus which is conventionally available to be expensive and hence, in turn, the articles which are formed using this apparatus are expensive to purchase. When one considers the materials from which the articles are manufactured is relatively cheap, it is the expense of the apparatus which is currently available, which causes the price to be increased. Furthermore, the expense of purchase of the apparatus means that the size and volume of manufacturer of these articles are required to be on a relatively large scale and there is at present no facility or apparatus available which can be used to form articles such as baskets which can be economically used by manufacturers of formed metal articles.

An alternative type of apparatus exists which does not utilise hydraulics but requires each of the bars of a blank to be bent separately prior to being joined together, whereupon the blank is then twisted in one direction. However, this process is time consuming as each bar has to be bent to the same degree and then joined together to form the blank.

The aim of the present invention is to provide apparatus which allows articles such as baskets to be formed without the need for hydraulic system to be provided but in a form which allows a quality and ease of manufacture of these baskets to be maintained if not improved.

SUMMARY OF THE INVENTION

The present invention, in a first aspect, provides apparatus for forming metal from a blank form, said apparatus comprising a first location portion for holding one end of the blank in a fixed position and, a second, rotatable location means for location of the other end of the blank characterised in that said location means is rotatable in a first direction with the location means maintained in a first position relative to the longitudinal axis of the blank and a second direction wherein the location means is movable along the longitudinal axis of the metal blank.

In a preferred embodiment the blank is formed from a plurality of bars secured together in a parallel relationship.

Typically the movement of the second position of the location means is toward the first location portion.

Preferably as the location means is rotated in the second direction the location means moves axially along the longitudinal axis of the blank.

In use, the rotation of the location means in the first direction imparts a twisting of the blank such that when the rotation of the location means in the first direction is complete, the metal blank is in a twisted condition. The rotation of the location means in a second, reverse direction, causes the metal bars of the blank to be separated increasingly as the position of the location means is moved inwardly towards the fixed location means. This movement causes each of the metal bars to move outwardly to form a bulbous shape and, at the same time, the degree of twist of the blank is changed such that the final shape created is bulbous with each of the bars bowing outwardly and each of the bars in a partially twisted condition.

In one embodiment, the second location means comprises a rotatable shaft mounted in a barrel, said shaft having a screw thread portion at least partially therealong, a means for rotating the shaft and a means for selectively engaging the screw thread with a screw thread on the barrel. In the first rotation direction, the shaft is rotated with the screw threads disengaged so that the location means is not caused to move along the longitudinal axis of the blank and, in the second rotation direction and upon commencement of the second rotation, the screw threads are engaged such that as the rotation means is moved to move the location means shaft in a second direction of rotation, the shaft is moved relative to the barrel and frame upon which the barrel and the fixed location means are located and hence the rotatable location means is moved towards the fixed location means by the screw thread movement.

In one embodiment, the rotation means is a handle for manual operation and the engagement means is a rod which is biased towards engagement with the screw thread portion such that, once the first rotation has been completed, the rod moves to engage the screw thread portion whereupon the direction of revolution is reversed such that the screw thread engaged therewith moves along the screw thread on the barrel. In an alternative embodiment the movable location means can be rotated by a powered motor which is controlled to selectively rotate the location means in the required direction and in the required sequence, but the principles of operation remain as before.

The position of the fixed location means can be altered to suit the length of the blank to be formed and typically the size of screw thread selected can be altered to determine the particular form of article to be created and also in relation to the size of the metal blank to be formed, although it is preferred that the screw threaded portion of the location means be a three start thread.

In one preferred embodiment the frame is slotted and the fixed location means are positionable therealong. Typically the slot is or has fitted thereto tapered means onto which a locking screw contacts such that the tapered effect prevents the fixed location means being forced away from the blank during formation of the same into a basket.

It is also envisaged that the apparatus can include other components in certain embodiments to allow metal bars to be twisted using the apparatus of the invention and various other forming actions to be undertaken, including the formation of collars to allow the basket to be fitted to the twisted bars and also other formations such as scrolls and circles.

In one embodiment when twisted bars are to be formed the bar can pass through the fixed location means and also the shaft of the movable location means to allow the bar to be fed into the apparatus and twisted at separate and intermediate locations by selective operation of the movable location means in the first direction as the bar is fed into the apparatus and this is a further inventive aspect of the invention.

Specific embodiments of the invention will now be described with reference to the accompanying drawings, wherein:

DETAILED DESCRIPTION OF THE PREFERRED

Figures 1, 2, 3:
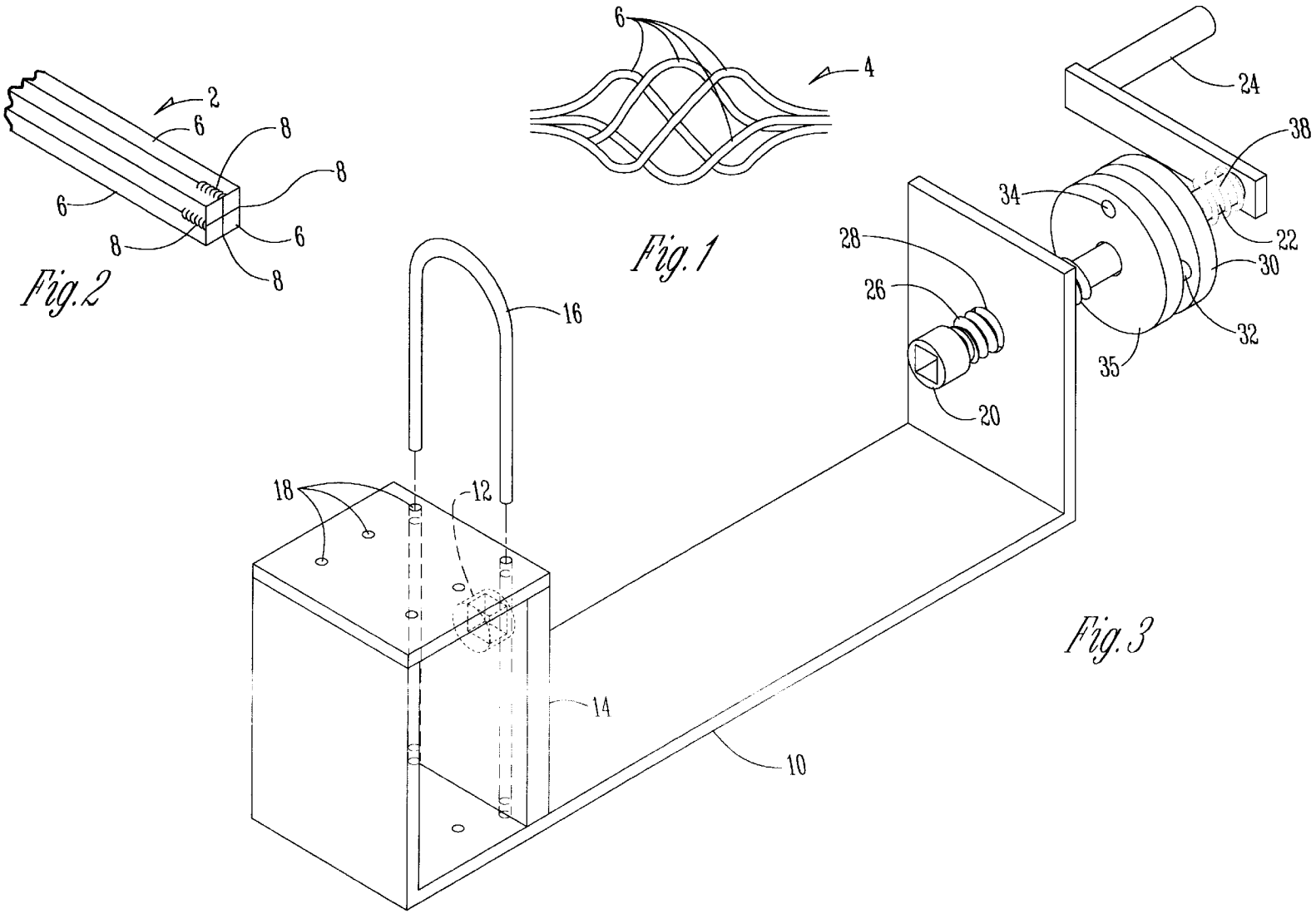
FIG. 1 illustrates a metal blank which has been formed into a basket made using the apparatus of the invention.
FIG. 2 illustrates a metal blank prior to being formed.
FIG. 3 illustrates a perspective view of the apparatus in a first embodiment of the invention.

Referring firstly to FIGS. 1 and 2, there is illustrated a metal blank 2 in FIG. 2 which is used to form a basket 4 as shown in FIG. 2 therefrom. As can be seen, in FIGS. 1 and 2, the blank comprises four lengths of metal bar 6 which are held in parallel position with the ends of the same being joined together by means of welding or other means 8 as shown.

Figure 4A:
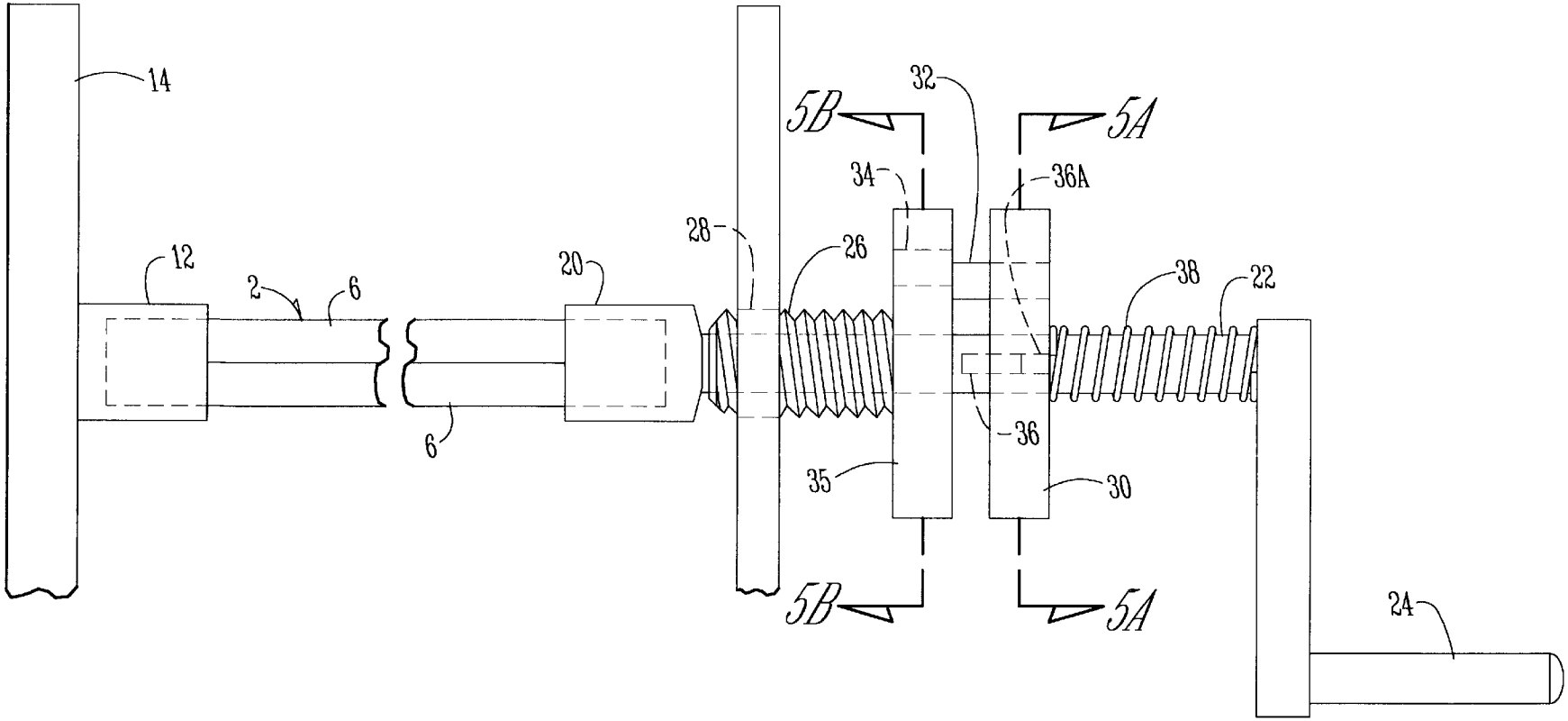
FIG. 4A is a front elevation view of the apparatus of FIG. 3 with the metal blank inserted therein.
Figure 4B:
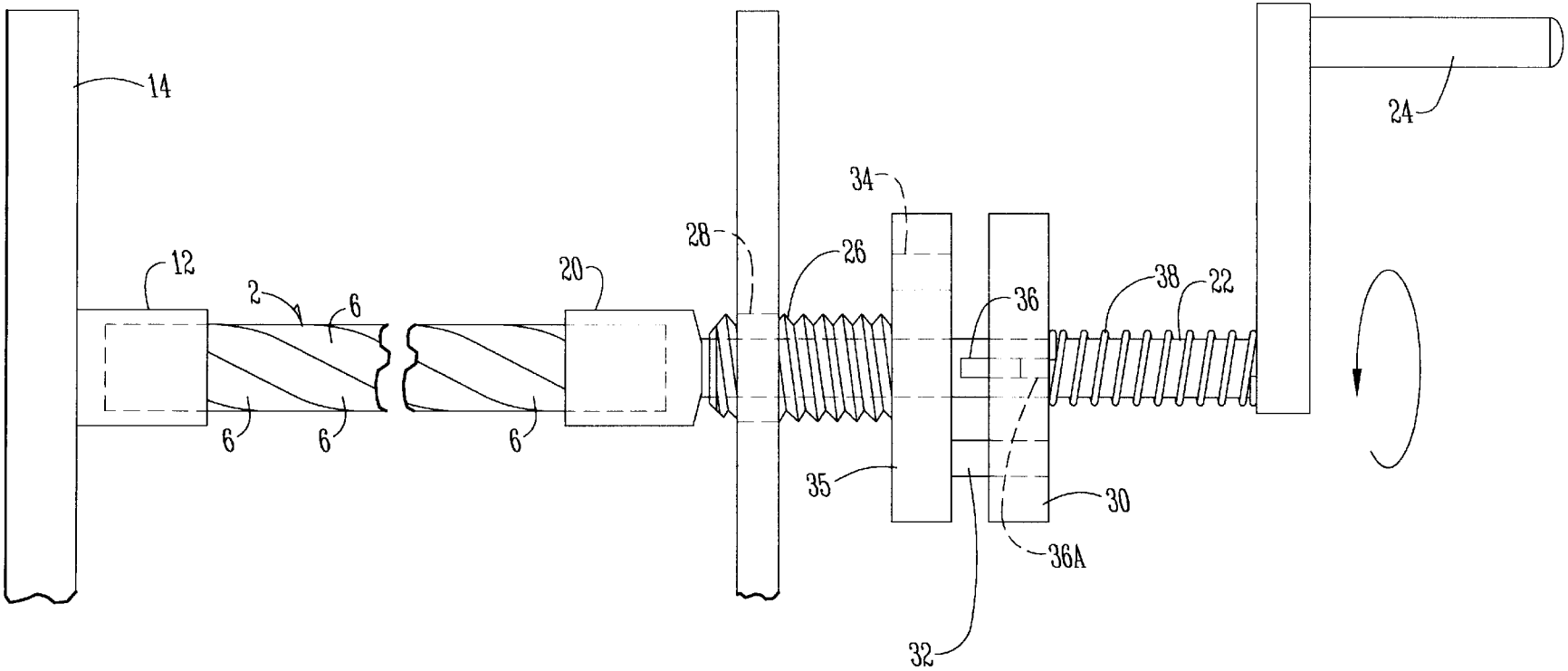
FIG. 4B is a front elevation view of the apparatus and blank of FIG. 4A once the handle has been rotated in one direction.
Figure 4C:
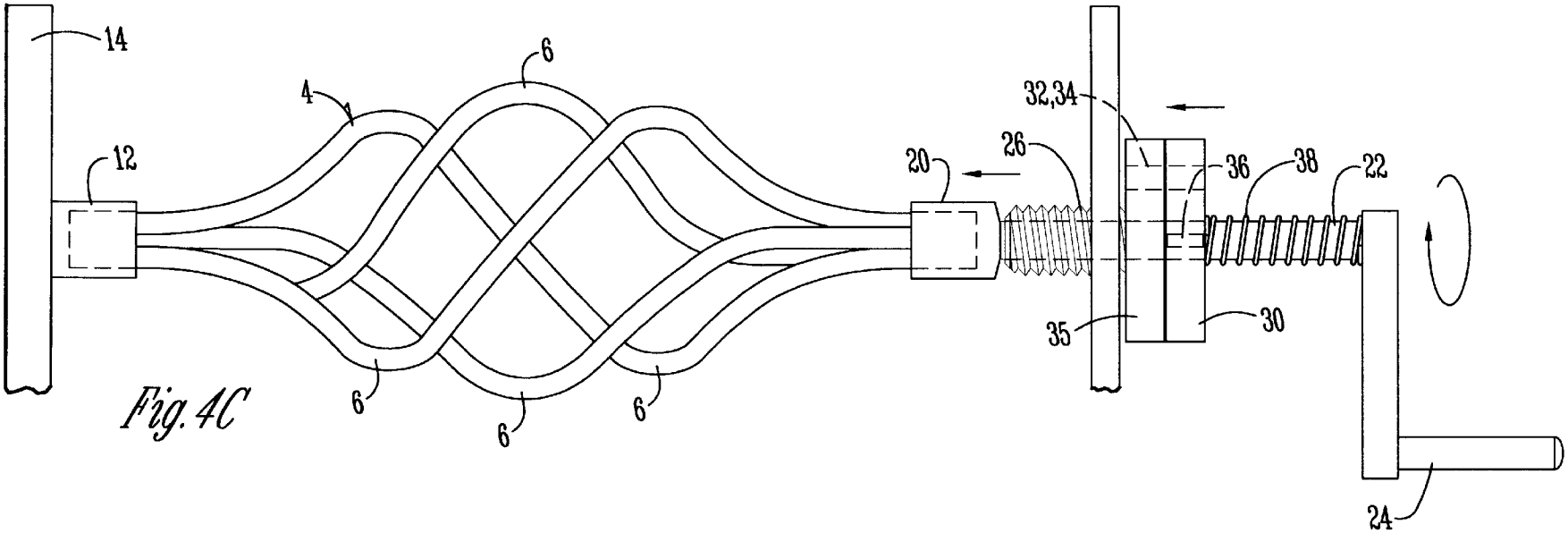
FIG. 4C is a front elevation view of the apparatus and blank of FIG. 4B after the handle has been rotated in the other direction to form the blank into a basket shape.
Figure 5A:
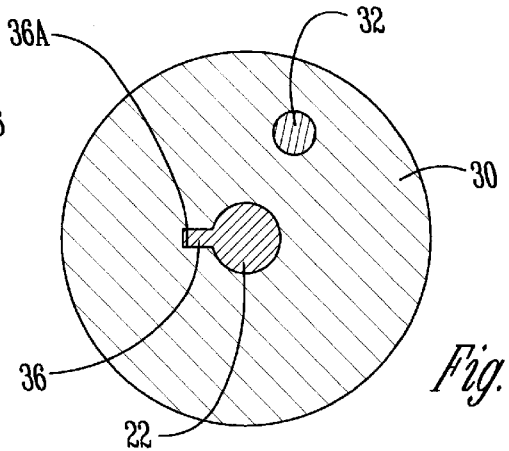
FIG. 5A is a cross sectional view taken along line 5A—5A in FIG. 4A.
Figure 5B:
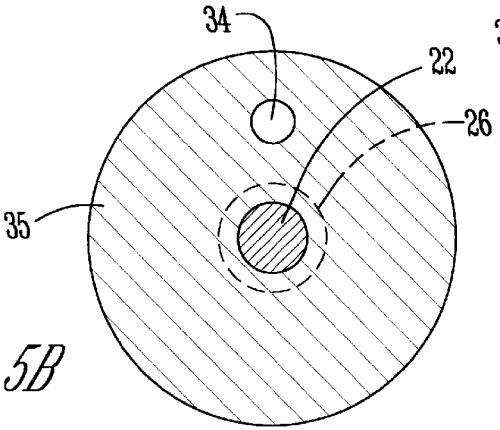
FIG. 5B is a cross sectional view taken along line 5B—5B in FIG. 4A.

FIGS. 3 to 5 illustrate apparatus in one embodiment according to the invention for use in forming a basket as shown in FIG. 1 and the apparatus comprises a frame 10 upon which is located at one end a fixed first location means 12 which is provided on a plate 14 which is held in position by pin 16. Typically the frame comprises a plurality of location points 18 to allow the position of the location means 12 to be selected as appropriate. Towards the other end of the frame there is provided a rotatable second location means 20 and said location means (12, 20) serve to provide location for the ends of the blank 2 placed therebetween. The rotatable location mean in this embodiment is mounted on a rotatable shaft 22 and is connected to a manually actuable handle 24 but this could equally be replaced by a motor driven arrangement. Also provided on the shaft and to be selectively coupled thereto is a screw thread portion 26 which is provided in threaded engagement with a barrel section 28 fixed to the frame and through which the shaft and screw thread portion pass. The rotatable means of the shaft is provided with a flange 30 which has a protrusion 39 provided thereon for location selectively in a matching aperture 34 in a flange 35 connected to the screw thread 26. Also provided on the shaft is lug 36 for selective engagement with the flange 30 and, a spring 38, which urges the flange 30 towards the screw flange 35.

In use, the blank 2 is placed with an end of the same located in fixed location means 12 and the other end in location means 20. Referring now to FIG. 4, the rotatable shaft 22, flange 30 and handle 24 are rotated in a first direction with the location protrusion 32 disengaged from the flange 35 such that the location means 20 rotates and, as it rotates, exerts a twisting action on the metal blank 2 to twist the same. Typically, the protrusion 32 and aperture 34 on the flange 35 are arranged such that as the flange 30 is rotated, and is biased towards the flange 35 by the spring 38, so when the protrusion 32 is at the same position as the aperture 34 it passes into the aperture to engage the flange 35 and screw thread 26 with rotatable shaft 22. At this point, the direction of revolution of the shaft is reversed and the location means 20 is now engaged with the screw thread which moves relative to the frame 10, upon rotation. Thus the location means, in addition to rotating, also moves towards the fixed location means 12 and, as it does so, the bars 6 of the blank 2 are forced to bow outwardly. At the same time the degree of twist of the bars 6 is reduced. Thus, when the required rotation of the location means 20 in the second direction is completed, a basket 4 is formed and FIG. 5 illustrates a formed basket which has been removed from the location means.

Once the basket has been formed to the required shape as shown in FIG. 5, the location means 12 is removed to allow removal of the basket.

Typically, the size of the thread will determine the extent of bowing of the bars 6 of the blank but typically the location means 20 is movable in the first rotatable direction by ¾'s—1 revolution and then rotated in the opposite direction with the screw thread engaged by 1–2 revolutions, thus providing the required forming action on the metal blank.

Figure 6:
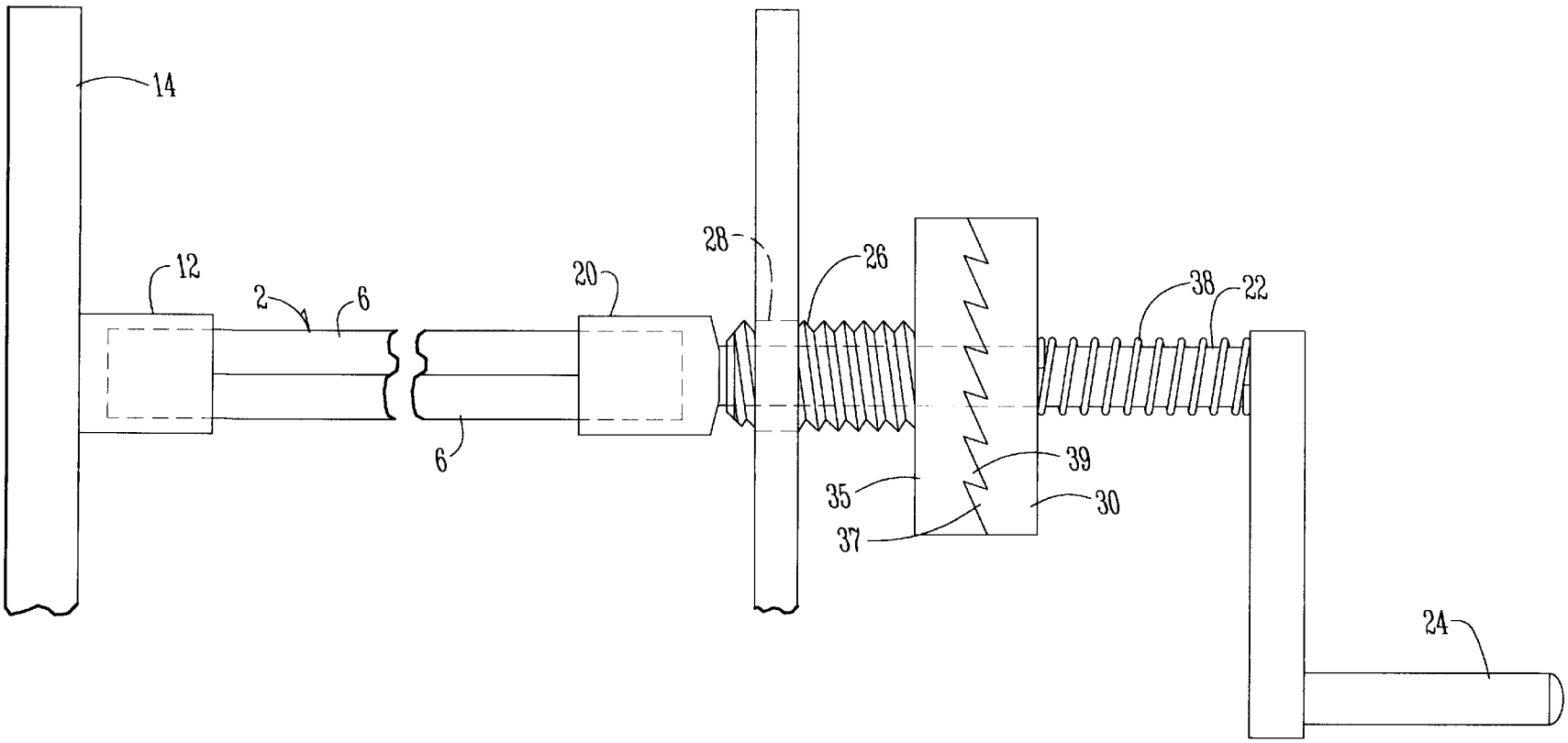
FIG. 6 illustrates a further embodiment of the apparatus as described in FIGS. 3, 4A, 4B, 4C, 5A, and 5B.

FIG. 6 illustrates a variation of the apparatus of FIGS. 3–5 wherein the protrusion 32 and aperture 34 of the flanges 30 and 35 of the movable location means 20 are replaced by teeth 37, 29 engaged to drive the screw thread in the same manner as described in relation to FIGS. 3–5.

Figure 7:
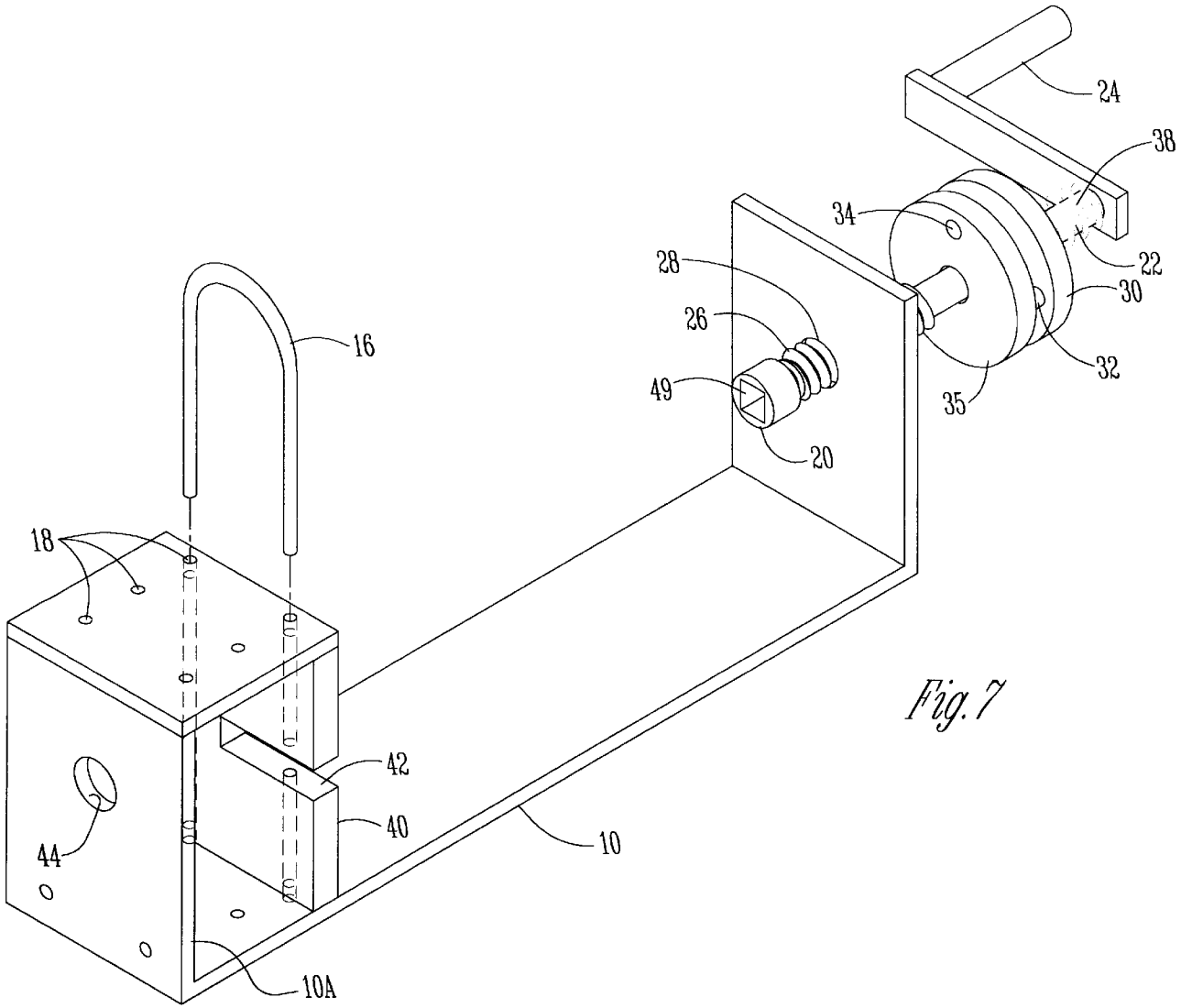
FIG. 7 illustrates apparatus according to the invention in a second embodiment for a second purpose.

Referring now to FIG. 7, there is illustrated a further feature of the apparatus of the invention wherein the apparatus described in relation to the rotatable location means 20 is as described in relation to FIGS. 1 to 5 but the fixed location means 12 is replaced by a plate 40 having a slot 42 formed therein. The plate is fixed in position and in this form the apparatus is for use in forming lengths of bar into a twisted condition and is performed by moving flange 30 which, in its normal position for making baskets and pressing collars, lies over lug 36 on shaft 22. When moved, the flange 30 is pulled away from flange 35 and then turned slightly so that a small notch 36A as shown in FIG. 5 on the flange 30 engages with lug 36. In this form the flanges 30, 35 are kept apart and in a neutral position. In this condition the handle can be used to turn shaft 22 without engagement of the flanges and twisting of the solid square bar occurs. When twisting is completed flange 30 can be taken off the notch and returned over lug 36 to make baskets and press collars once more. If only a portion of the bar is to be twisted, the remainder of the length of the bar can be passed through the aperture 44 in the frame 10 and thus, lengths of bar can be twisted using the apparatus of the invention. Furthermore as the shaft 22 has a port 49 therein, the bar can be passed through the port 49 to allow the bar to be fed into the apparatus.

Figure 8:
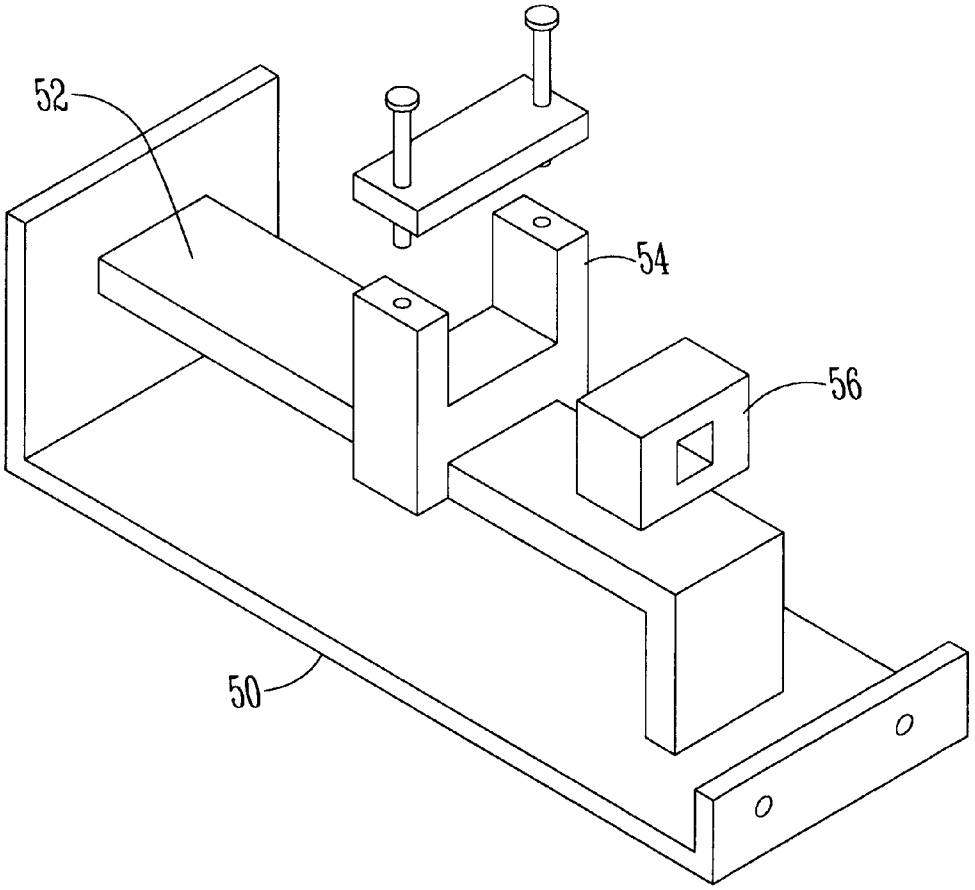
FIG. 8 illustrates further apparatus for the embodiment shown in FIG. 7.

FIG. 8 illustrates a further apparatus for use with the apparatus of FIG. 7 wherein, if the bar to be formed is longer than the frame 10 at the portion which is to be formed and twisted is longer than the frame 10, then the additional frame 50 can be attached to the frame end 10A. The frame 50 is provided with a bar 52 along which is slidably positionable a block 54 which can be used to locate the end of the bar which is to be formed using the apparatus. If required an insert 56 can be moved into the block 54 for a bar of a smaller section. Thus this additional part of apparatus allows the use of the apparatus of the invention to be extended.

Figure 9:
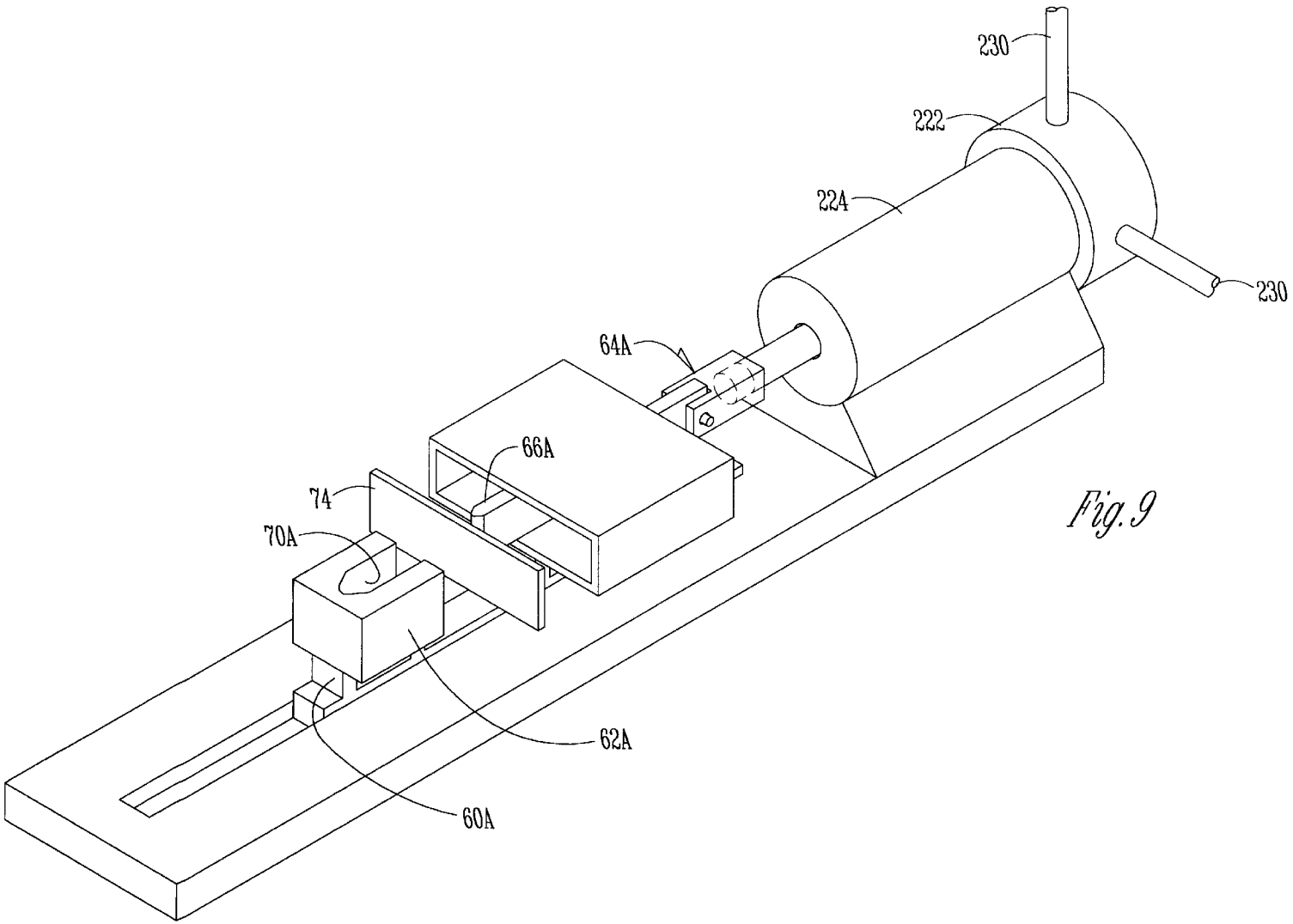
FIG. 9 illustrates apparatus according to the invention for a third use in one embodiment.
Figure 10:
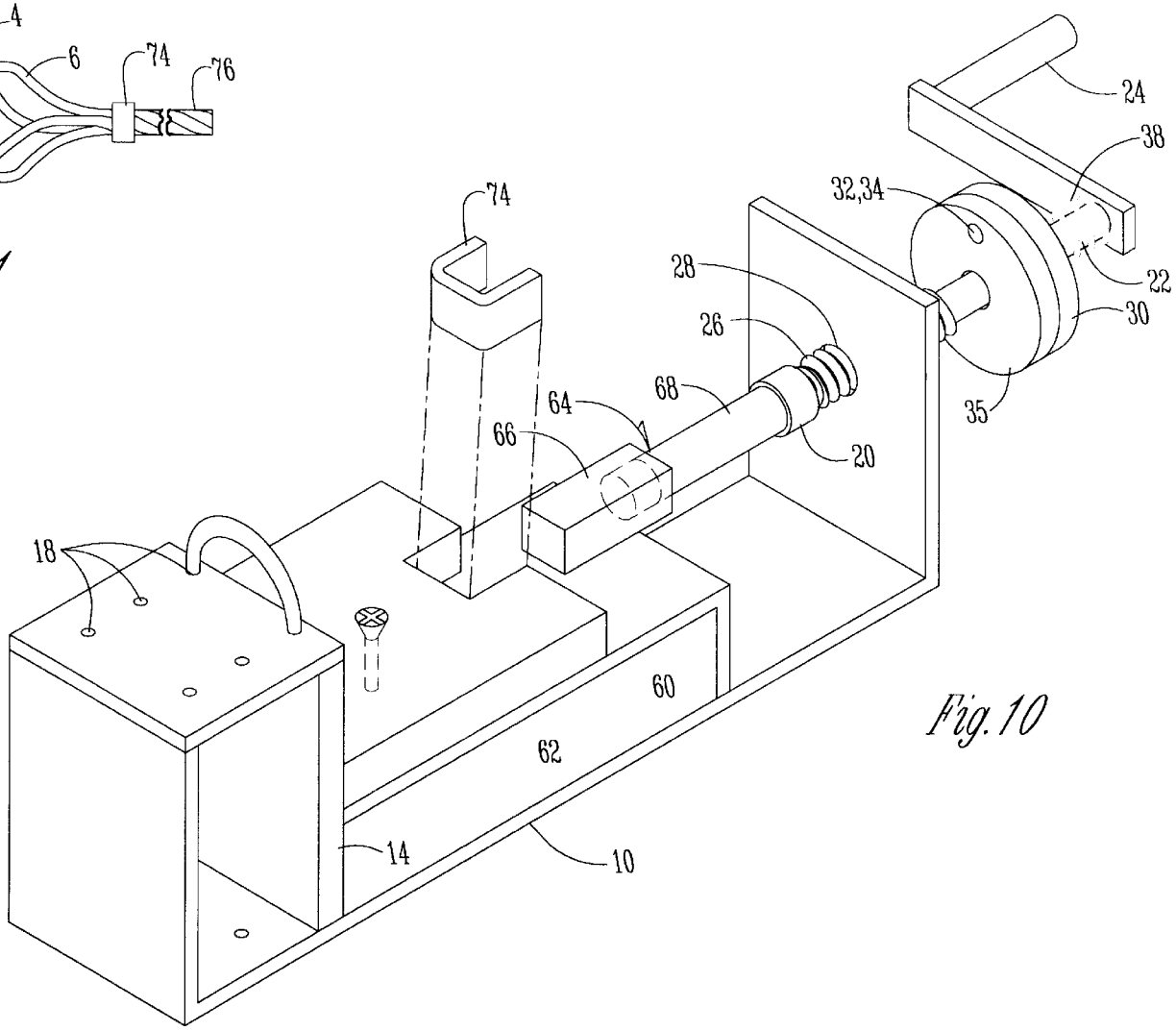
FIG. 10 illustrates the apparatus for the use of FIG. 9 in a different embodiment.

FIGS. 9 and 10 illustrate the apparatus of the invention for a further use in two embodiments wherein a plate 60 replaces the fixed location means and to this plate 60 is located a forming block 62. In FIG. 10 the movable location means 20 and accompanying apparatus is as previously described but provided in the location means 20 is a push rod 64 with a block 66 and rotatably mounted lengths 68 such that, in use, in one embodiment the flanges 30 and 35 are engaged as shown in such that rotation of the shaft 22 causes the location means 20 to rotate and to move inwardly as the screw thread 26 is engaged with the frame 10. As the location means 20 rotates so the length 68 rotates relative to the block 66 and, as location means 20 moves towards the forming block 62, so the block 66 is moved in towards the slotted aperture 70 in the forming block 62. This apparatus is used for forming a collar from a strip of sheet metal 74 which is placed between the block 66 and the forming block 62 over the face of the aperture 70, as shown in broken line, such that as the block 66 is moved into the slotted aperture 70, the strip material is formed into a collar shape between the block 66 and walls of the slotted aperture 70. The collar 74, when formed, is shown in FIG. 10. The embodiment of FIG. 9 includes similar components 60A, 62A, 64A, 66A, 70A, and a different form of movable location means and this is described in detail with regard to FIGS. 16A–D, 17 and 18.

Figure 11:
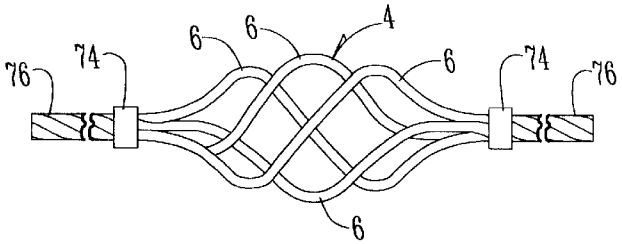
FIG. 11 illustrates the finished article formed using the various pieces of apparatus of the invention.

FIG. 11 illustrates an article incorporating a basket 4, which is joined to twisted rods 76 and 78 by means of collars 74, all of which can be formed using the apparatus of the invention.

Figure 12:
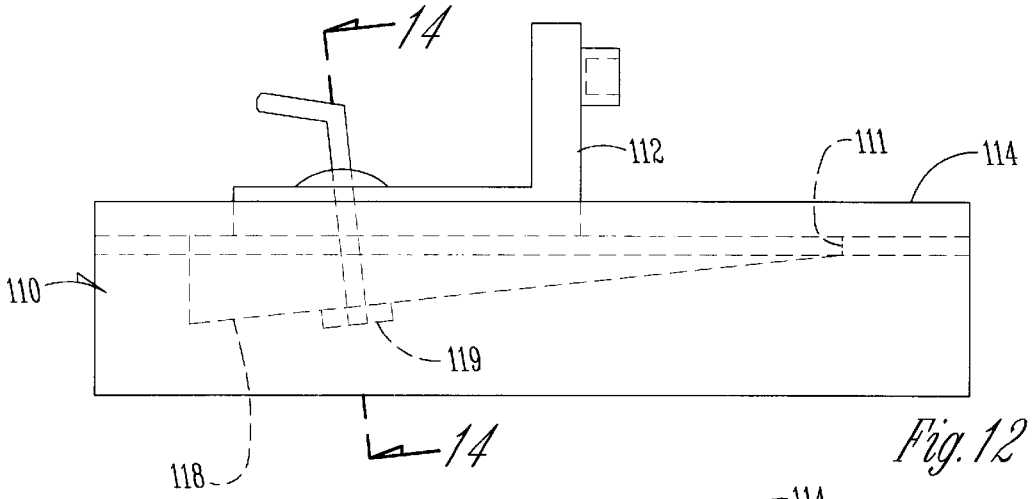
FIGS. 12, 13 and 14 illustrate an alternative embodiment of the apparatus.
Figure 13:
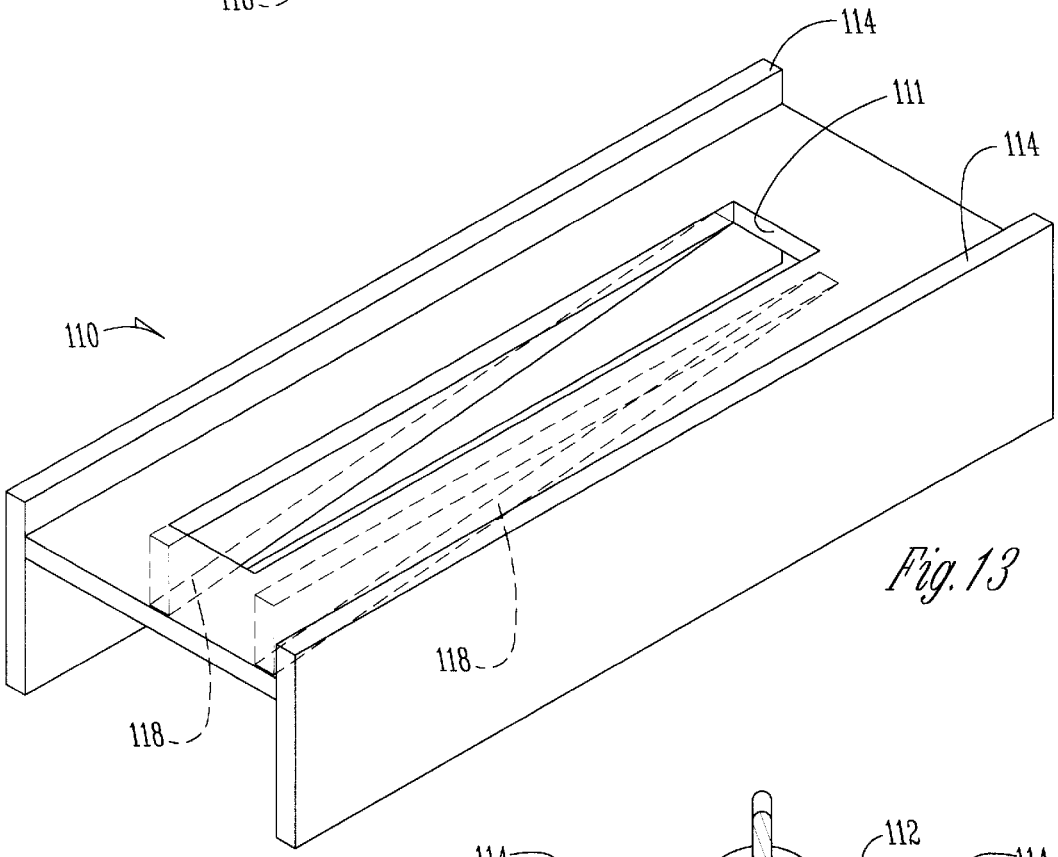
Figure 14:
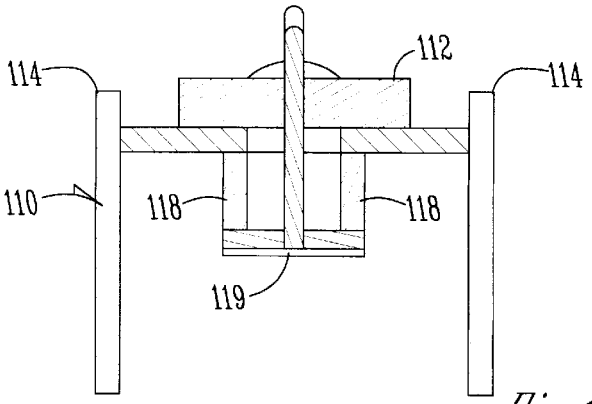

FIGS. 12, 13 and 14 illustrate the frame 110 in an alternative form with a slot 111 and side rails 114 for the reception of a fixed location means 112 therein. The slot is provided adjacent the side walls on the underside with sloping protrusions 118 with which a locking means 119 provided on the location means 112 can contact to retain the location means 112 in the desired position for forming the basket as previously described with reference to FIGS. 3–5. As the locking means contacts the protrusions 118 which slope away from the position of the rotatable location means (not shown) so the fixed location means 112 is prevented from being forced away from the rotatable location means due to the forces exerted by the twisting and compressing of the blank into a basket as the slope prevents movement of the locking means 119. This arrangement replaces the fixed location means 12 of FIGS. 3–5 and has the advantage of extra strength and resistance to forces exerted thereon.

Figure 15:
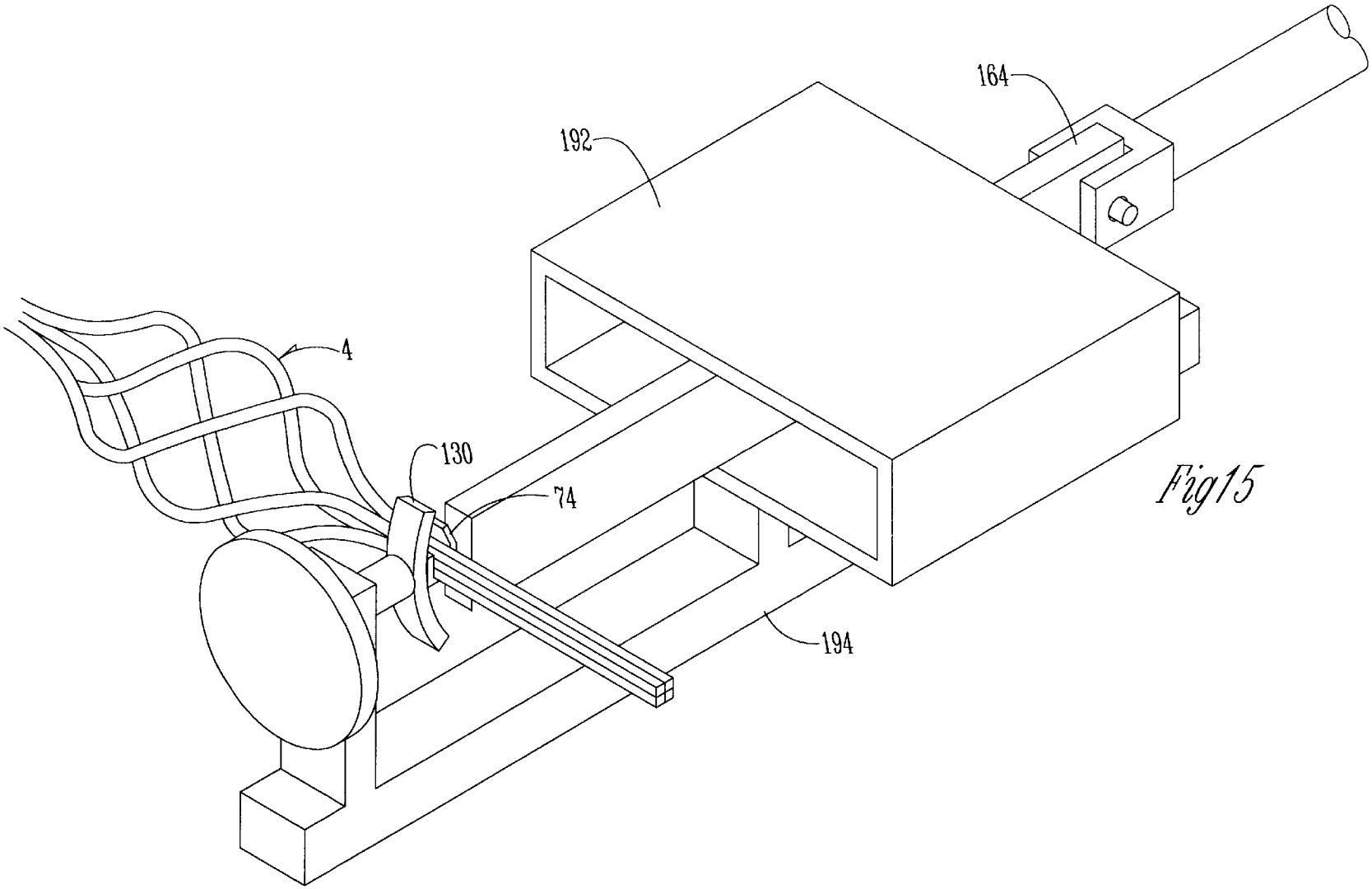
FIGS. 15 illustrates a further alternative arrangement of the invention.

FIG. 15 illustrates a further embodiment of the apparatus wherein a clamping means 130 is provided to clamp the collar round the basket as shown.

Figure 16A:
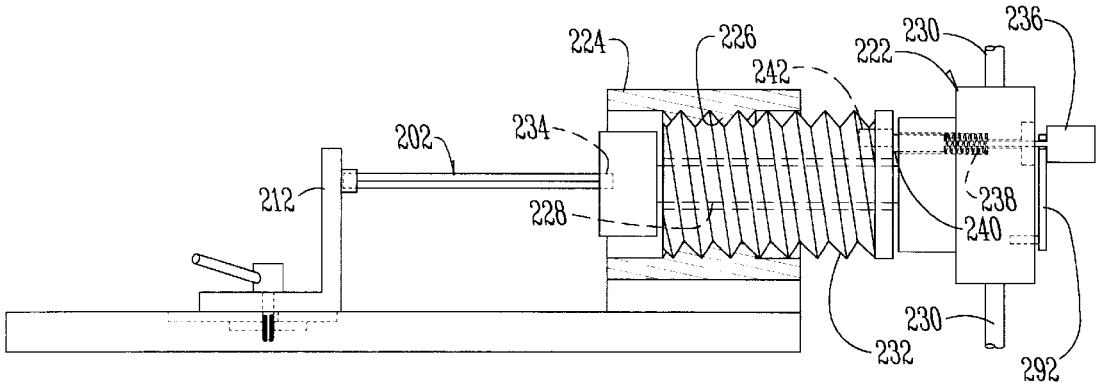
FIGS. 16A–D illustrate a further embodiment of the basket forming and bar twisting apparatus of the invention.
Figure 16B:
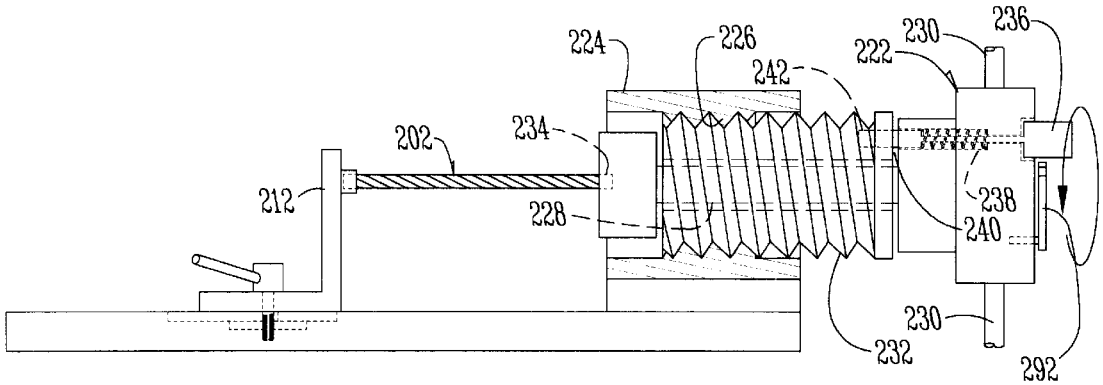
Figure 16C:
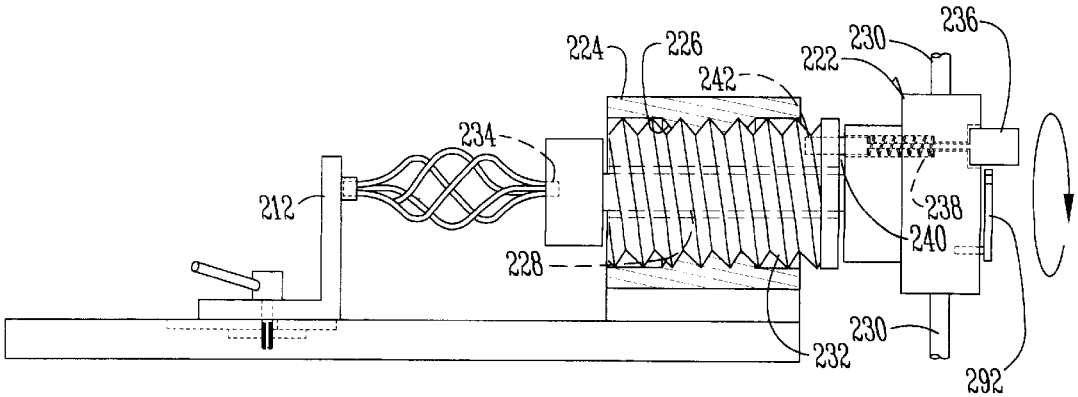
Figure 17:
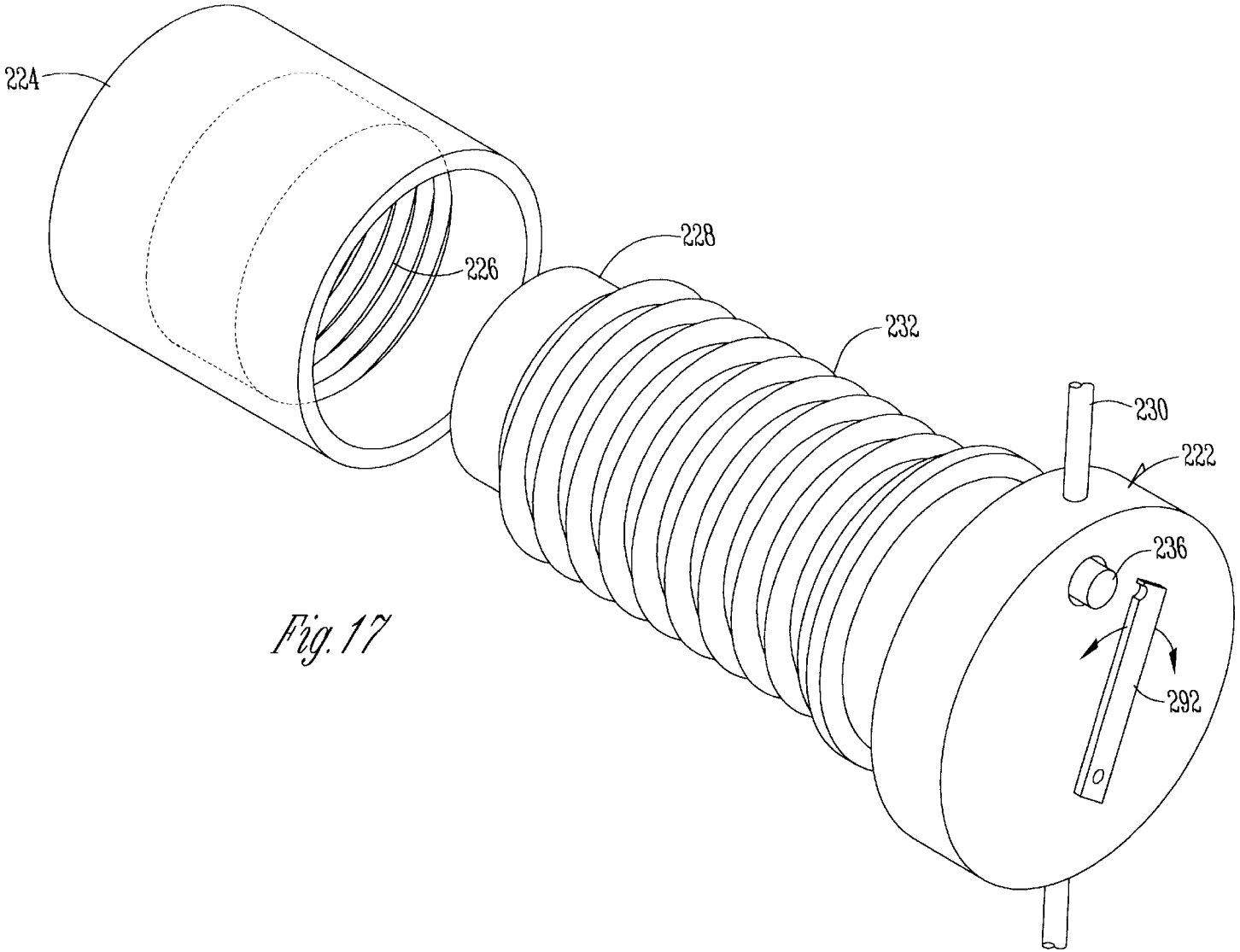
FIG. 17 illustrates a location means and associated barrel according to the embodiment of FIG. 16A–D.
Figure 18:
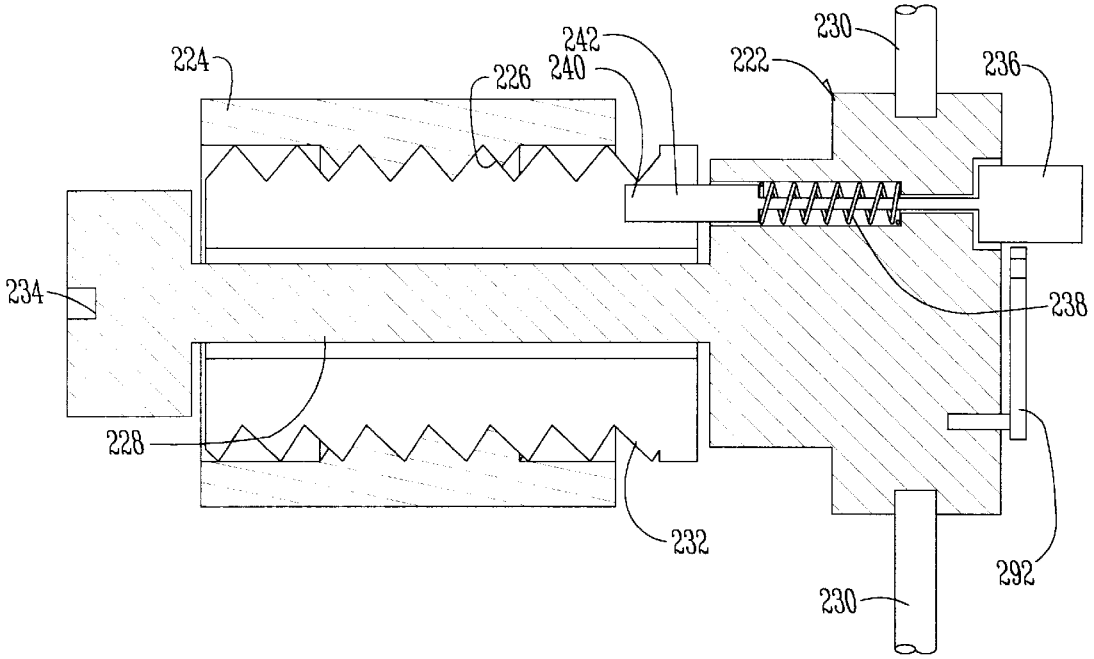
FIG. 18 illustrates a section showing the location means and barrel of FIG. 17 in engagement.

FIGS. 16A–C illustrate an alternative embodiment of apparatus for forming baskets and 16D shows alternative apparatus for twisting bars which operates on the same principles as the previously described apparatus but in this instance the movable location means 222 arrangement differs and this is described in detail in FIGS. 17 and 18. In use the procedure is the same as before in that the blank 202 is placed between fixed location means 212 and movable location means 222 as shown in FIG. 16A. The movable location means are then rotated in a first direction by rotating the handle 230 and in this direction the shaft 228 is disengaged from the barrel 224 so that only rotational movement takes place and hence the blank 202 twists as shown in FIG. 16B. Upon completion of rotation in the first direction the shaft is engaged with the barrel and rotated in the reverse direction and the engagement causes linear and rotational movement thereby causing bowing of the blank 202 and the bars 206 to separate to form the basket shape as shown in FIG. 16C.

FIGS. 17 and 18 illustrate the alternative movable location means 222 which is engaged with a barrel 224 which is fixed with the frame of the apparatus. On the interior of the barrel is fixed a threaded section 226. The movable location means 222 is formed of a shaft 228 with at one end a socket 234 for the blank and is rotatable by the handle 230 as shown in FIG. 18. Mounted on the shaft and selectively engagable therewith is a screw threaded portion 232. The blank is engaged in the socket 234 as before and the handle 230 and shaft 228 rotated in a first direction with a rod 236 held by the surface of the screw threaded portion 232 against a biasing spring 238 and thereby disengaging the screw thread portion 232. When the end of the first revolution approaches, the end 240 of the rod, which moves along the screw threaded portion, reaches an aperture 242 in its path, and the biasing spring 238 acts to move the rod into the aperture in the screw threaded portion and engage the same so that rotation of the shaft in the reverse direction causes the screw threaded portion and screw thread on the barrel to engage and hence location means to move relative to the barrel 224 towards the other location means and cause the bowing of the twisted blank.

Figure 16D:
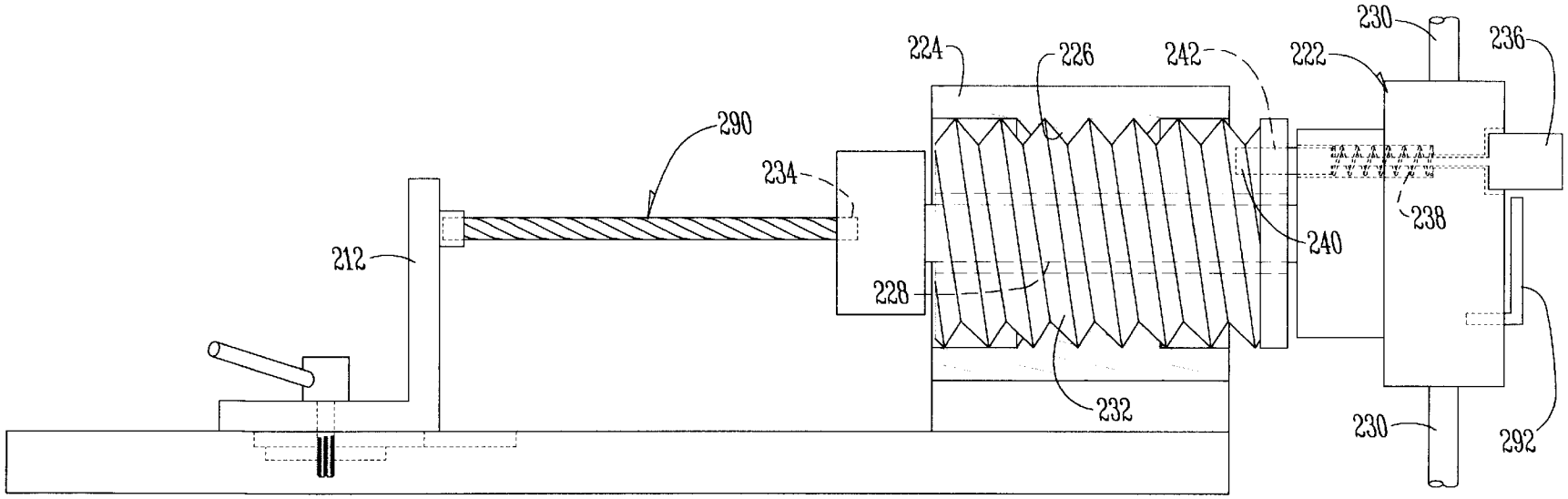

It should also be appreciated that the movable location means 222 of this embodiment can be used for any of the other uses previously described with reference to the earlier figures and one such use is shown in FIG. 16D wherein a blank 290 is held in the fixed location means 212 and passes through the a longitudinal aperture in the shaft 228 of the movable location means 222. In this arrangement the rod 236 is held against the biasing spring by catch 292 so that the rod cannot move to an engaging position with the screw threaded portion 232 and hence the handle 230 and shaft 228 can be rotated through several revolutions in the first direction to cause the blank 290 to twist as required.

Thus, it can be seen, that the apparatus of the invention as described herein can be used for a plurality of uses and, in one particular embodiment can be used to form a basket and also to form a complete article including a basket which is joined to twisted rods and all of the components are formed using the apparatus of the invention in various embodiments.

We claim:

1. Apparatus for forming metal from a blank form, said apparatus comprising a location portion for holding one end of the blank in a fixed position and, a movable location means for location of the other end of the blank characterised in that said location means is selectively rotatable in a first direction with the location means maintained in position relative to the longitudinal axis of the blank and a second direction when the location means is movable along the longitudinal axis of the metal blank.

2. Apparatus according to claim 1 wherein the blank is formed from a plurality of bars secured together in a parallel relationship.

3. Apparatus according to claim 1 wherein the movement of the movable location means along the longitudinal axis is towards the first location portion.

4. Apparatus according to claim 1 wherein as the movable location means is rotated in the second direction the location means moves axially along the longitudinal axis of the blank.

5. Apparatus according to claim 1 wherein rotation of the location means in the first direction imparts a twisting of the blank such that when the rotation of the location means in the first direction is complete, the metal blank is in a twisted condition.

6. Apparatus according to claim 5 wherein rotation of the location means in a second, reverse direction, causes the metal bars of the blank to be separated increasingly as the position of the location means is moved inwardlv towards the fixed location means.

7. Apparatus according to claim 6 wherein the movement in the second direction causes each of the metal bars to move outwardly to form a bulbous shape and, at the same time, the degree of twist of the blank is changed such that the final shape created is bulbous with each of the bars bowing outwardly and each of the bars in a partially twisted condition.

8. Apparatus according to claim 1 wherein, the second location means comprises a rotatable shaft mounted in a barrel, said shaft having a screw thread portion at least partially therealong, a means for rotating the shaft and a means for selectively engaging the screw thread with a screw thread on the barrel.

9. Apparatus according to claim 8 wherein in the first direction of rotation, the shaft is rotated with the screw threads disengaged so that the location means stays in the same axial position and prior to, or upon, commencement of the second rotation, the screw threads are engaged so that rotation causes the shaft and the location means to move relative to the barrel and the fixed location means.

10. Apparatus according to claim 1 wherein rotation is provided by applying a force to a handle.

11. Apparatus according to claim 10 wherein rotation of the movable location means is by powered drive.

12. Apparatus according to claim 1 wherein the apparatus is provided with engagement means which are movable between a disengaged position when the movable location means is rotated in a first direction and an engaged position when the location means is rotated in the second direction.

13. Apparatus according to claim 12 wherein the engagement means is a rod which is biased towards the engagement position.

14. Apparatus according to claim 13 wherein the rod is provided such that once the first rotation has been completed, the rod moves to engage the screw thread portion of the location means with the screw thread portion on the barrel such that when the direction of revolution is reversed to the second direction the screw thread engaged therewith moves along the screw thread on the barrel.

15. Apparatus according to claim 14 wherein the dimension of screw thread can be selected and changed to determine the particular form of article to be created and also in relation to the size of the metal blank to be formed.

16. Apparatus according to claim 1 wherein the position of the first location portion can be altered prior to, or during, the forming operation to suit the length of the blank to be formed and/or the form to be created.

17. Apparatus according to claim 16 wherein the first location portion is fitted in position along a slot in a frame and the slot is tapered to prevent the fixed location means being forced away from the blank during formation of the same.

18. Apparatus according to claim 1 wherein the apparatus includes a catch to prevent engagement means which causes the engagement of screw threads in the movable location means from engaging during rotation of the movable location means in the first direction and thereby allows the formation of a twisted bar.

19. Apparatus according to claim 1 wherein the rotational movement of the movable location means is translated into linear movement to allow a pressing action to be exerted to form metal blanks into a required form.

* * * * *